US006095711A

United States Patent [19]

Garfinkle

[11] Patent Number: 6,095,711

[45] Date of Patent: Aug. 1, 2000

[54] FLIP PACKET

[76] Inventor: Benjamin L. Garfinkle, 1120 Portal Ave., Piedmont, Calif. 94610

[21] Appl. No.: 08/978,822

[22] Filed: Nov. 26, 1997

Related U.S. Application Data

[63] Continuation of application No. 08/222,456, Apr. 4, 1994, abandoned.

[51] Int. Cl.[7] ..... B42F 3/02

[52] U.S. Cl. ..... 402/19; 402/80 P

[58] Field of Search ..... 402/19, 20, 26, 402/75, 80 P, 80 R

[56] References Cited

U.S. PATENT DOCUMENTS

| | | | |
|---|---|---|---|
| 904,618 | 11/1908 | Kellner, Jr. | 402/75 X |
| 2,380,780 | 7/1945 | Novak . | |
| 2,543,437 | 2/1951 | Claxton . | |
| 2,547,166 | 4/1951 | Nelson et al. . | |
| 2,718,229 | 9/1955 | Gregory . | |
| 4,422,785 | 12/1983 | Shore . | |
| 4,500,223 | 2/1985 | Downing et al. | 402/80 P X |
| 4,792,253 | 12/1988 | Jacobson | 402/20 |
| 4,840,406 | 6/1989 | Pitts . | |
| 5,015,114 | 5/1991 | Miller . | |

FOREIGN PATENT DOCUMENTS

| | | | |
|---|---|---|---|
| 748623 | 7/1933 | France | 402/26 |
| 1145569 | 10/1957 | France | 402/20 |
| 2708880 | 9/1977 | Germany | 402/80 R |
| 565972 | 12/1944 | United Kingdom | 402/19 |
| 577762 | 5/1946 | United Kingdom | 402/80 R |

OTHER PUBLICATIONS

The STN Quick Reference Cards.

*Primary Examiner*—Willmon Fridie, Jr.
*Attorney, Agent, or Firm*—Malcolm B. Wittenberg

[57] ABSTRACT

A stack of sheet material defining a packet assembly. Each sheet is provided with a single elongated slot spaced from one of its edges such that each sheet is captured by a single tubular element providing for the stack of sheet material to be in registry. A tubular element is provided with a slit extending throughout its longitudinal surface for capturing each sheet of the stack maintaining the sheets in registry within the stack and providing for rotation of each sheet about the tubular element.

6 Claims, 4 Drawing Sheets

FLIP PACKET

This is a continuation of application Ser. No. 08/222,456 filed on Apr. 4, 1994 now abandoned.

TECHNICAL FIELD OF THE INVENTION

The present invention deals with a stack of sheet material being bound by a resilient tubular element. Elongated slots are provided within each sheet which are captured by the tubular element to maintain each sheet in registry within the stack and to provide for rotation of each sheet about the tubular element. The present invention is particularly adapted for use as signage in the sale of retail products.

BACKGROUND OF THE INVENTION

In supermarkets and similar environments where a wide range of diverse products are displayed for purchase by consumers, it is necessary to provide for a multitude of different types of signage. Although signage displaying product pricing and identifying information have been uniquely adapted for such diverse environments as refrigerated deli cases, produce stacks and in the display of boxed dry goods, all signage used in grocery stores and similar retail environments have at least one thing in common—that is, the product identifying information and pricing be capable of being rapidly and conveniently changed as the need arises for the prices of products constantly change requiring store clerks to update signage information frequently.

It has now been proposed that a convenient sign system could consist of a flip packet where plastic sheeting would be employed such that when product identification and pricing change, the plastic sheeting could merely be flipped about an axis resulting in the convenient and efficient display of current product information.

In the past, tubular binding elements have been proposed although their use in the present environment has not proven satisfactory. For example, U.S. Pat. No. 2,718,229 suggests the use of a tubular binder for a "loose leaf" assembly of paper sheets. In this instance, the patentee teaches the use of a tubular binding element having a transversely resilient body presenting a continuous longitudinal surface having open ends. It is proposed that this tubular element bend upon itself to provide a shorter longitudinal dimension whereby the open ends fit over binding tabs provided within each of the sheet-like elements. It has been found, however, that the bending of the tubular member is inconvenient and constant usage rapidly causes deterioration of the tabs which results in tab failure and subsequent release of the paper sheets from the overall stack.

FIGS. 1–3 depict typical prior art approaches to maintaining a flip chart or flip binding, each of which exhibits certain inherent shortcomings. For example, helical wire 51 is caused to pass within aligned openings 52 in order to maintain sheets 53 as a packet. However, due to the helical nature of wire 51, as pages are flipped, they ride along the helix and don't uniformly align. Further, helical wire such as element 51 is costly to manufacture.

FIG. 2 depicts a generally plastic configuration whereby binding element 60 is shown to possess individually tubular segment 61 attached by a spine 62. In light of the spine, however, pages which have been flipped are incapable of traveling 360° around tubular segment 61 and thus an appropriate flip chart cannot be configured.

FIG. 3 depicts yet another type of wire binding element whereby "C" shaped wires 70 are channeled within appropriately spaced openings found within sheet material. However, like the embodiment of FIG. 2, the sheets cannot be flipped 360° around such an element and, thus, a flip packet where each sheet of the packet is expected to lie flat against its preceding flipped sheet cannot be configured using such an embodiment. Also, such products tend to be made of metal and are expensive and, in addition, generally rust in due course.

Unfortunately, there has not been an instance where a suitable flip packet has been provided to perform the functions as noted above. In this regard, it was deemed important that any such invention be provided with the attributes of ease of manufacture, low cost of production, rustproof and, most importantly, has the ability to rapidly and conveniently exchange individual elements of sheet material as the need arises.

It is thus an object of the present invention to provide a stack of sheet material in the form of a flip packet for use in supermarkets or similar retail environments which is inexpensive to manufacture and which is capable of presenting to a user a rapid and convenient means of replacing and exchanging individual sheets within the flip packet stack.

This and further objects will be more readily apparent when considering the following disclosure and appended claims wherein FIGS. 1–3 depict prior art approaches to packet assembly binding configurations;

FIG. 4 provides in perspective a single sheet within a suitable packet assembly together with two alternative tubular retaining elements; and FIGS. 5, 6 and 7 are side views of a stack of sheet material each being provided with a different embodiment of tubular retaining elements.

SUMMARY OF THE INVENTION

The present invention is directed to a stack of sheet material defining a packet assembly thereof. The stack comprises a plurality of sheets, each sheet having a substantially flat body and having an edge provided with a single elongated slot spaced a defined distance from the edge, the elongated slot of each sheet being equal in size and location to those of all other sheets in the stack. The sheets contained with the stack are assembled with their single respective elongated slots in registry throughout.

A single tubular element is provided having a radially resilient body presenting a longitudinal surface having open ends and a substantially circular cross-section of substantially uniform radius greater than the defined distance of the elongated slots from the edge of each sheet. The longitudinal surface of the tubular element is shorter than the length of the elongated slots of each sheet as well. The tubular element is further provided with a slit extending throughout its longitudinal surface through which each edge of each sheet extends providing for the passage of the tubular element through the elongated slot of each sheet of the stack to maintain each sheet in registry within the stack and to provide for rotation of each sheet about the tubular element.

DETAILED DESCRIPTION OF THE INVENTION

It is the intent of the present invention to improve upon the tubular binder of the '229 patent recognizing that the present invention is intended to be used in a retail environment where constant changing of sheet material is necessary as product pricing and identifying information changes. In this regard, reference is made to FIG. 1 wherein sheet 10 is shown as the first sheet of a suitable stack ideally configured of planar plastic elements.

Each sheet 10 is provided with a substantially flat body having an edge 25. Each sheet is further provided with a single elongated slot 11 spaced a defined distance 24 from edge 25 whereby the elongated slot of each sheet is equal in size and location to those of all other sheets in the stack.

Figure 1:
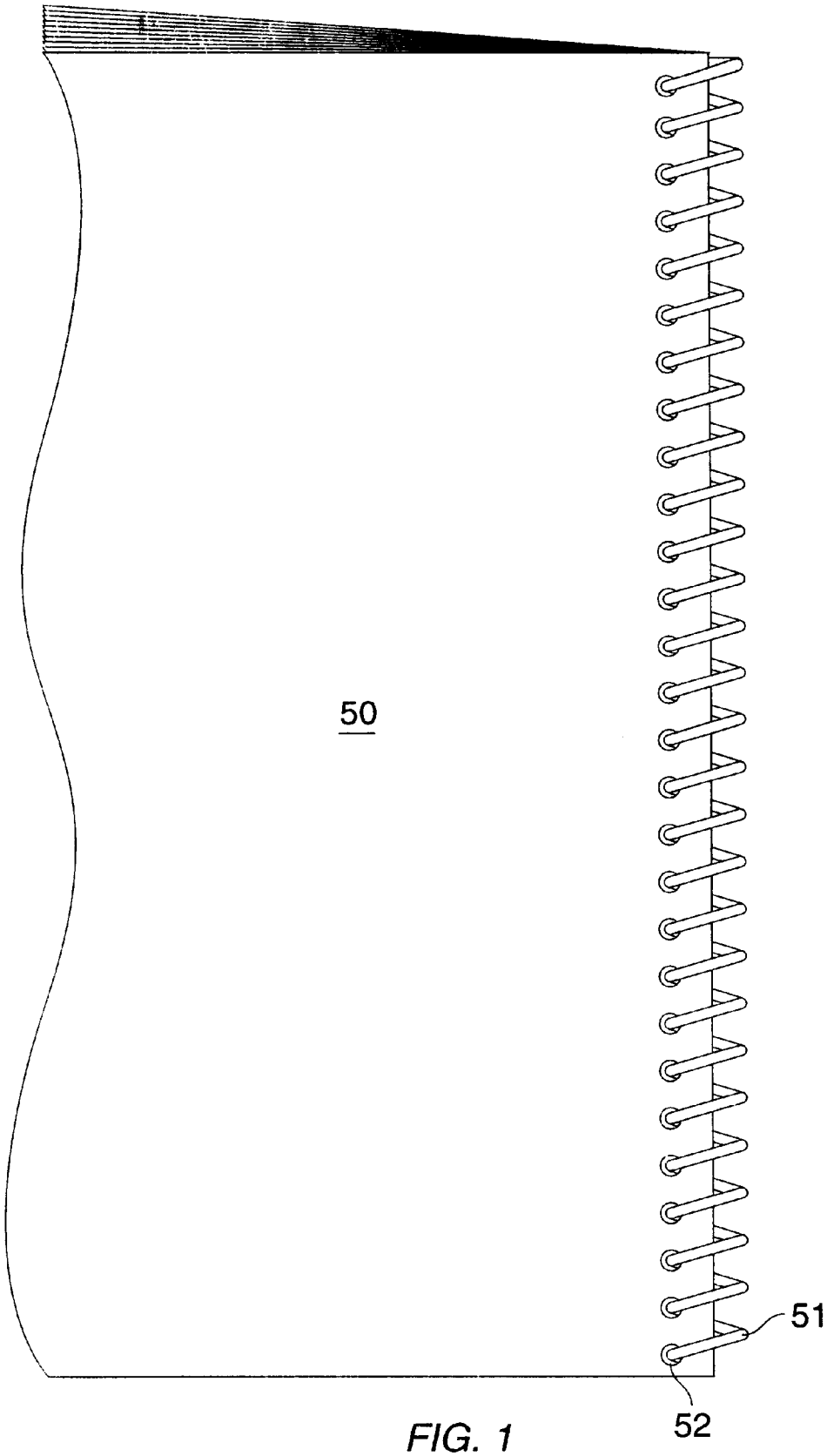
FIG. 1 PRIOR ART
Figure 2:
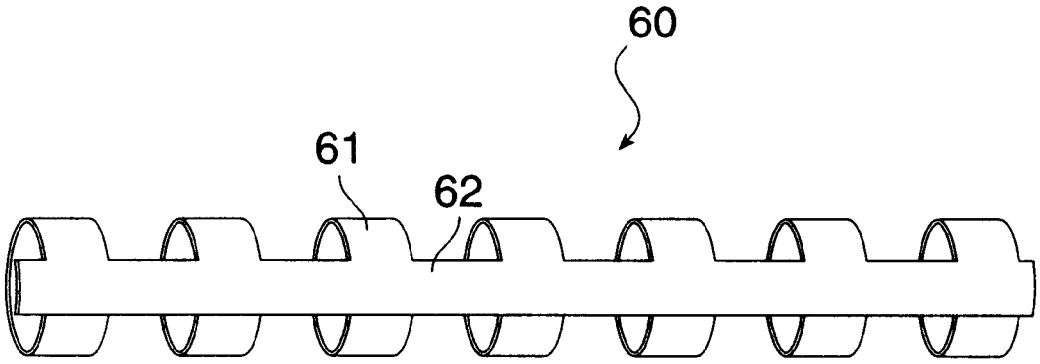
FIG. 2 PRIOR ART
Figure 3:
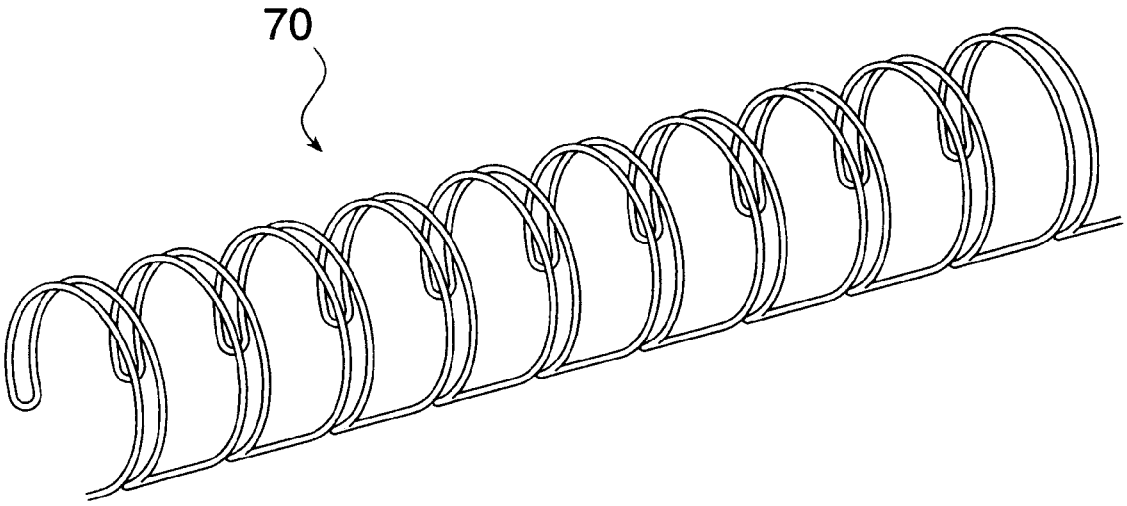
FIG. 3 PRIOR ART

It is contemplated that each of sheets 10 are assembled with their respective elongated slots 11 in registry throughout the stack of sheets. Tubular elements 12, 13 and 20 are characterized as having radially resilient bodies presenting a longitudinal surface having substantially circular cross-sections 15, 35 and 45 of substantially uniform diameter. The phrase "radially resilient body" is intended to mean that the tubular elements are capable of expanding radially to enable them to capture various sheets 10. Expanding of tubular element 12 is shown in FIG. 1 whereby tubular element 12 is radially expanded at slit 14 providing an open passageway to capture sheets 10.

It is proposed that the radius of each tubular element be greater than the defined distance created by the spacing between edge 25 and elongated slot 11. It is further proposed that each tubular element be provided with a longitudinal surface shorter than the length of slot 11 to enable the various tubular elements to capture each sheet 10 and to enable each sheet to rotate about an axis created by the single tubular elements employed.

Each tubular element is provided with a slit 14, 17 and 21 extending throughout the longitudinal surface thereof. As previously noted, each edge 25 of the each sheet 10 is intended to pass within a suitable tubular member by radially enlarging the tubular member as shown in FIG. 1 (tubular member 12). Once capture has been carried out, the tubular member is released and it resiliently reassumes its substantially circular cross-section completing the binding of the various sheet elements 10. As such, elements can be rapidly removed or added to the flip packet while providing for rotation of each sheet about an axis established by the tubular member.

Unlike the invention disclosed in U.S. Pat. No. 2,718,229, the elongated slot 11 of sheet material 10 are spaced from edge 25 such that the slot forms a rectangular shaped area completely bound by said sheet material. In other words, a portion of sheet material 10 at area 24 provides for the complete enclosure of slot 11. This provides for a much more long-lasting, resilient and easier to use flip packet than that suggested by the '229 patent.

It is noted that, typically, tubular elements 12, 13 and 20 are extruded and made of plastic in a tubular configuration which retains that configuration through the lifetime of the present product. Each tubular element is provided with a length and radius, the length being the length of the longitudinal surface and the radius being greater than the distance between edge 25 and slot 11.

As preferred embodiments, it is proposed that various tubular elements be provided with certain embellishments shown as elements 13 and 20 herein. In this regard, element 13 is created by providing material which is greater than the circumference of the proposed tubular element such that overlap 17 is provided along the longitudinal axis of tubular element 13 within the vicinity of the configured slit. This embodiment assists in preventing the inadvertent removal of sheet members 10 from the overall flip packet stack.

Figure 4:
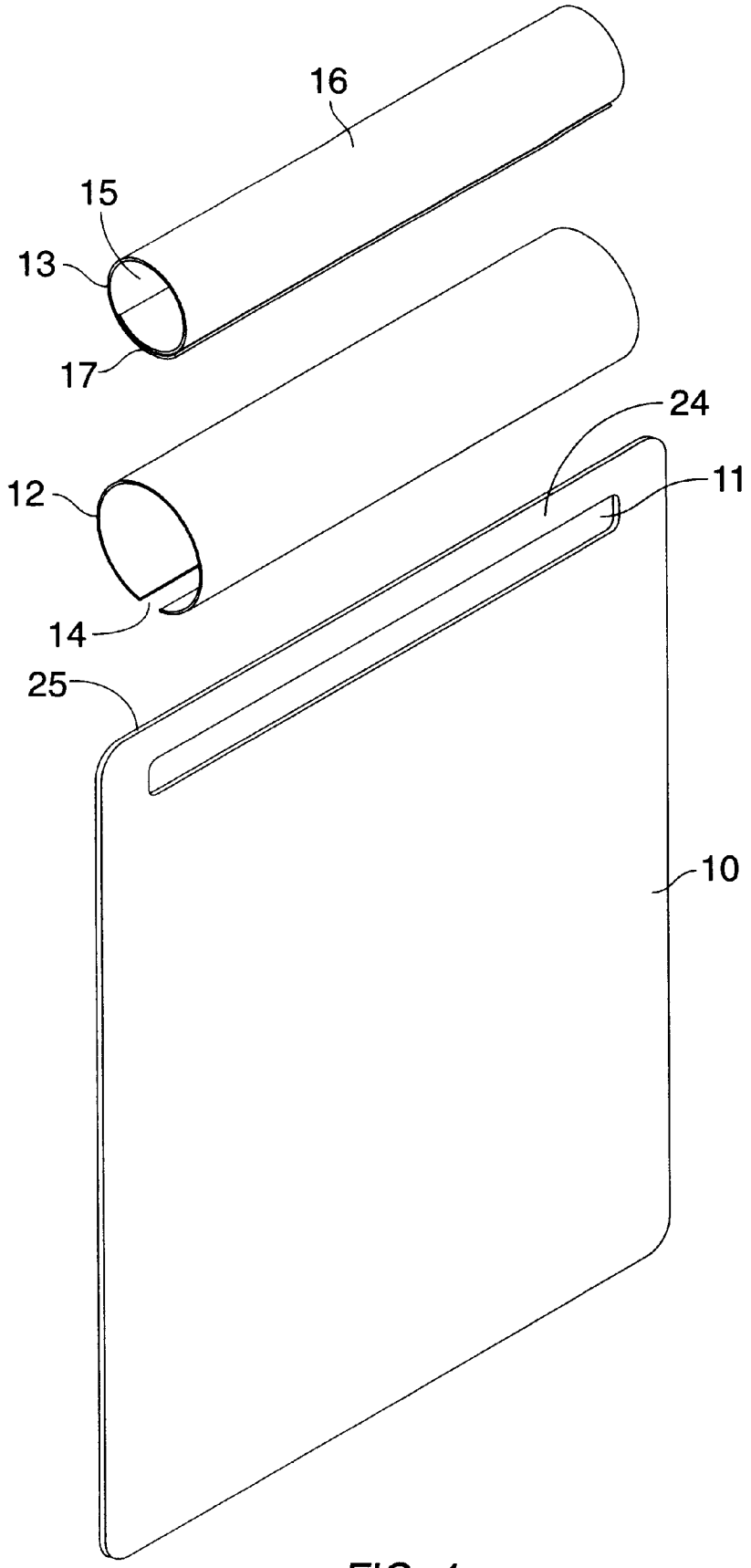
Figure 5:
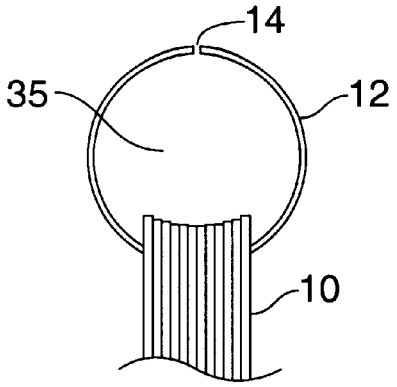
Figure 6:
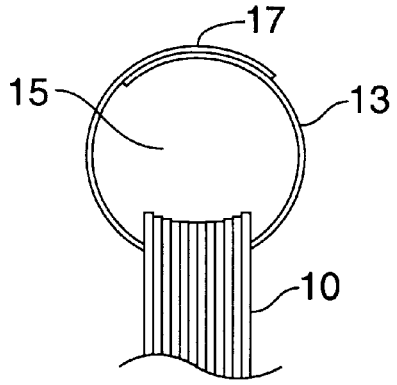
Figure 7:
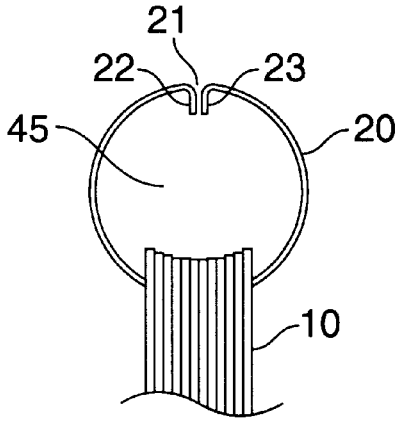

Yet another configuration is shown in FIG. 4 whereby tubular element 20 is again created by providing material which, in this instance, is greater than the circumference of the proposed tubular element to provide the tubular element with a creased and turned-in portion along each length dimension. Upon the formation of the tubular element, the turned-in portion creates a pair of turned-in legs 22 and 23 along slit 21. Although the tubular element substantially creates a circular cross-section 45, turned-in legs 22 and 23 further prevent sheet elements 10 from being inadvertently removed from the stack and which also facilitates assembly by creating a lead in engagement for each sheet through slit 21.

I claim:

1. A stack of sheet material defining a packet assembly thereof, said stack consisting of a plurality of sheets, each sheet having a substantially flat body and having an edge provided with a single elongated slot spaced a defined distance from said edge, the elongated slot of each sheet being equal in size and location to those of all other sheets in said stack, the sheets being assembled with the single respective elongated slot in registry throughout the stack of sheets and a single tubular element having a radially resilient body presenting a longitudinal surface having a substantially circular cross-section of substantially uniform radius greater than said defined distance of said elongated slot from said edge of each sheet, said longitudinal surface being shorter than the length of said elongated slot, said tubular element further being provided with a slit extending throughout the longitudinal surface thereof through which said edge of each sheet extends providing for the passage of said tubular element through the elongated slot of each sheet of said stack to maintain each sheet in registry within the stack and to provide for 360° rotation of each sheet about said tubular element.

2. The stack of sheet material of claim 1 wherein each elongated slot of said sheet material is spaced from said edge such that each slot forms a rectangularly shaped area completely bound by said sheet material.

3. The stack of sheet material of claim 1 wherein said tubular element is configured from extruded plastic having a length and radius, said length being the length of said longitudinal surface and the radius being greater than the distance between defined distance.

4. The stack of sheet material of claim 3 wherein said tubular element is provided with material greater than the circumference of said tubular member resulting in an overlap along said longitudinal axis.

5. The stack of sheet material of claim 3 wherein said tubular member is provided with a crease and turned-in portion along its length dimension forming a pair of turned-in legs along said slit and throughout said longitudinal axis.

6. The stack of sheet material of claim 1 wherein said tubular member comprises a body of extruded plastic.

* * * * *